US010808426B2

(12) United States Patent
deLoache, III et al.

(10) Patent No.: US 10,808,426 B2
(45) Date of Patent: Oct. 20, 2020

(54) LIGATURE-RESISTANT COVER FOR SECURING WALL-MOUNTED DEVICES

(71) Applicant: Behavioral Safety Products, LLC, Watkinsville, GA (US)

(72) Inventors: Robert Lee deLoache, III, Watkinsville, GA (US); David Cory deLoache, Watkinsville, GA (US); Mark Mendes, Loganville, GA (US)

(73) Assignee: BEHAVIORAL SAFETY PRODUCTS, LLC, Athens, GA (US)

( * ) Notice: Subject to any disclaimer, the term of this patent is extended or adjusted under 35 U.S.C. 154(b) by 237 days.

(21) Appl. No.: 16/001,450

(22) Filed: Jun. 6, 2018

(65) Prior Publication Data

US 2019/0376319 A1 Dec. 12, 2019

(51) Int. Cl.
*E05B 65/00* (2006.01)

(52) U.S. Cl.
CPC ..... *E05B 65/006* (2013.01)

(58) Field of Classification Search
CPC ..... F24F 11/02; E05B 65/006; H02G 3/14; B05B 12/20
USPC ..... 220/3.8
See application file for complete search history.

(56) References Cited

U.S. PATENT DOCUMENTS

| | | | |
|---|---|---|---|
| 1,815,855 | A | 7/1931 | Lauritano |
| 2,860,348 | A | 11/1958 | McClenahan |
| 3,495,276 | A | 2/1970 | Suess |
| 3,573,344 | A | 4/1971 | Snyder |
| 3,729,113 | A | 4/1973 | Lopatka |
| 3,901,406 | A | 8/1975 | Kivett |
| 3,924,279 | A | 12/1975 | Morris et al. |
| 3,987,502 | A | 10/1976 | Hartmann |
| D261,799 | S | 11/1981 | Alger |
| D264,620 | S | 5/1982 | Kaiser |
| 4,558,472 | A | 12/1985 | Fromme et al. |
| D284,303 | S | 6/1986 | Yvetot |
| 4,895,455 | A | 1/1990 | Horning |

(Continued)

FOREIGN PATENT DOCUMENTS

GB 2502290 11/2013

OTHER PUBLICATIONS

U.S. Appl. No. 15/987,295, filed May 23, 2018, deLoache III, et al.

(Continued)

*Primary Examiner* — Anthony D Stashick
*Assistant Examiner* — L Kmet
(74) *Attorney, Agent, or Firm* — Mitch Harris, Atty at Law; Andrew M. Harris

(57) ABSTRACT

A ligature-resistant thermostat cover provides restriction of access to a thermostat and prevention of ligature formation around or atop the thermostat. The thermostat cover includes a wall plate for securing to a wall with a central aperture for accommodating a thermostat, a cover portion and a locking mechanism. The cover portion is curved both toward the top and toward the bottom of the cover from an apex line to provide a continuously curving front surface of the cover portion. The rear profile of the cover portion matches a mating surface of a front profile of the wall plate in width and height and the wall plate has an incline or curvature at the top face to provide a continuously sloping surface that prevents formation of a ligature point above the top face.

20 Claims, 13 Drawing Sheets

(56) References Cited

U.S. PATENT DOCUMENTS

| | | | |
|---|---|---|---|
| D311,242 | S | 10/1990 | Reid |
| 4,962,550 | A | 10/1990 | Ikenaga et al. |
| 5,251,340 | A | 10/1993 | Su-Land |
| D342,523 | S | 12/1993 | Morgan et al. |
| D374,830 | S | 10/1996 | Dexter et al. |
| 5,680,949 | A | 10/1997 | Roesler |
| 5,810,193 | A | 9/1998 | Gordon |
| D412,974 | S | 8/1999 | Birsel et al. |
| D427,155 | S | 6/2000 | Pawley et al. |
| D429,696 | S | 8/2000 | Taylor |
| D432,503 | S | 10/2000 | Taylor |
| 6,129,109 | A | 10/2000 | Humber |
| D438,939 | S | 3/2001 | Kawamura |
| 6,627,816 | B1 | 9/2003 | Walker et al. |
| 6,644,557 | B1 | 11/2003 | Jacobs |
| 6,687,922 | B1 | 2/2004 | Marshall et al. |
| D507,192 | S | 7/2005 | Schroeder et al. |
| D509,575 | S | 9/2005 | Kergoet |
| 7,565,706 | B2 | 7/2009 | Janssen |
| D703,158 | S | 4/2014 | Parsons et al. |
| D733,270 | S | 6/2015 | Hao |
| 9,297,154 | B2 | 3/2016 | deLoache III, et al. |
| 9,309,993 | B2 | 4/2016 | Hall |
| D792,955 | S | 7/2017 | deLoache, III |
| 9,938,704 | B2 | 4/2018 | deLoache, III |
| 2003/0127458 | A1 | 7/2003 | Dushane et al. |
| 2004/0074663 | A1* | 4/2004 | Broussard, Jr. ..... H02G 3/14 174/67 |
| 2006/0207146 | A1* | 9/2006 | Gesel ..... A47G 1/06 40/757 |
| 2007/0062735 | A1* | 3/2007 | Craig ..... H02G 3/14 174/660 |
| 2007/0075844 | A1 | 4/2007 | Taylor |
| 2020/0018514 | A1* | 1/2020 | Howe ..... H05K 5/0017 |

OTHER PUBLICATIONS

U.S. Appl. No. 15/857,795, filed Dec. 29, 2017, deLoache III.

All Data Resource, "Safety Technology STI-9110 Thermostat Protector with Key Lock—Clear" downloaded from <http://www.alldataresource.com/Safety-Technology-STI-9110-Thermostat-Protector-with-Key-Lock--Clear_p_93690.html> on Mar. 23, 2018, 1 page.

Scorpion Security Products, "Dummy Speed Dome Security Camera (White)", downloaded from: <https://shop.scorpionsecurityproducts.com/product/dummy-speed-dome-security-camera-white/> on May 31, 2018, 4 pages (pp. 1-4 in pdf).

* cited by examiner

LIGATURE-RESISTANT COVER FOR SECURING WALL-MOUNTED DEVICES

BACKGROUND OF THE INVENTION

1. Field of the Invention

The present invention relates generally to locking covers for thermostats and other wall-mounted devices, and in particular, to a device cover around which a ligature does not anchor.

2. Description of the Related Art

Ligature-resistant design is a requirement in many institutional locations. In particular, in rooms where persons may be left unattended and where there is a risk that fixtures may be used as a support to tie a ligature, such as a belt, rope or a cloth, a way to ensure that the fixtures cannot be used in such a manner is desirable. In general, ligature-resistant design is an issue that exists any height above the floor, since objects above the floor can be used to support a ligature, even if one is not attachable.

Thermostat covers having locking features are in common-use in public places and private facilities such as hospitals, mental health facilities and incarceration facilities. In such private facilities it is desirable to secure the thermostat against unauthorized access, as in public facilities. Commercial thermostat covers are not suitable ligature-resistant designs and typically provide an upper surface around which a ligature can be attached, vents through which a ligature may be looped and a connection between the wall and the cover into which a ligature may be inserted.

Therefore, it would be desirable to provide a thermostat cover that prevents ligature formation and/or support of such ligatures.

SUMMARY OF THE INVENTION

The above objectives, among others, are achieved in a ligature-resistant device cover and a method of controlling access to a wall-mounted device.

The ligature-resistant device cover includes a wall plate for securing to a wall and with a central aperture for accommodating a thermostat or other device mounted on the wall inside or under the aperture. The ligature-resistant device cover further includes a cover portion that has a first curvature extending along the front from a bottom of the cover portion to an apex line and a second curvature extending along the front from a top of the cover portion and extending to the apex line so that the first curvature and the second curvature provide a continuously curving front surface of the cover portion. The rear profile of the cover portion has a mating surface that matches a mating surface provided on the front profile of the wall plate in width and height. The cover portion has a third curvature at a top face thereof that provides a continuously sloping surface preventing support of a ligature by the top face of the wall plate or a junction between the cover portion and the wall plate. The ligature-resistant device cover also includes a locking mechanism provided on the cover portion for securing the cover portion to the wall plate.

The foregoing and other objectives, features, and advantages of the invention will be apparent from the following, more particular, description of the preferred embodiment of the invention, as illustrated in the accompanying drawings.

BRIEF DESCRIPTION OF THE DRAWINGS

The novel features believed characteristic of the invention are set forth in the appended claims. The invention itself, however, as well as a preferred mode of use, further objectives, and advantages thereof, will best be understood by reference to the following detailed description of an illustrative embodiment when read in conjunction with the accompanying drawings, wherein like reference numerals indicate like components, and:

DESCRIPTION OF ILLUSTRATIVE EMBODIMENT

The present disclosure illustrates thermostat covers that provide ligature-resistant structure and installation. The ligature-resistant thermostat covers have a wall plate for securing to a wall and with a central aperture for accommodating a thermostat or other wall-mounted device mounted inside or under the aperture. The ligature-resistant thermostat cover further includes a cover portion that has a first curvature extending along the front from a bottom of the cover portion to an apex line and a second curvature extending along the front from a top of the cover portion and extending to the apex line so that the first curvature and the second curvature provide a continuously curving front surface of the cover portion. The rear profile of the cover portion has a mating surface that matches a mating surface on a front profile of the wall plate in width and height and has a third curvature at a top face thereof matching the first curvature, so that when the cover portion is secured to the wall plate, the wall plate and the cover portion provide a first continuously curved surface above the apex line and extending from the apex line to the wall. The bottom face of the wall plate may be similarly curved, and the sides of the cover portion may also be inclined or curved to meet the apex line. The ligature-resistant thermostat cover also includes a locking mechanism provided on the cover portion for securing the cover portion to the wall plate. The illustrated example is a molded plastic assembly in which the cover is formed from transparent or semi-transparent materials, although the invention is not limited as to materials or techniques of fabrication and opaque materials may be desirable in some applications where it is desirable not to allow visibility of wall mounted devices behind the cover.

Figure 1:
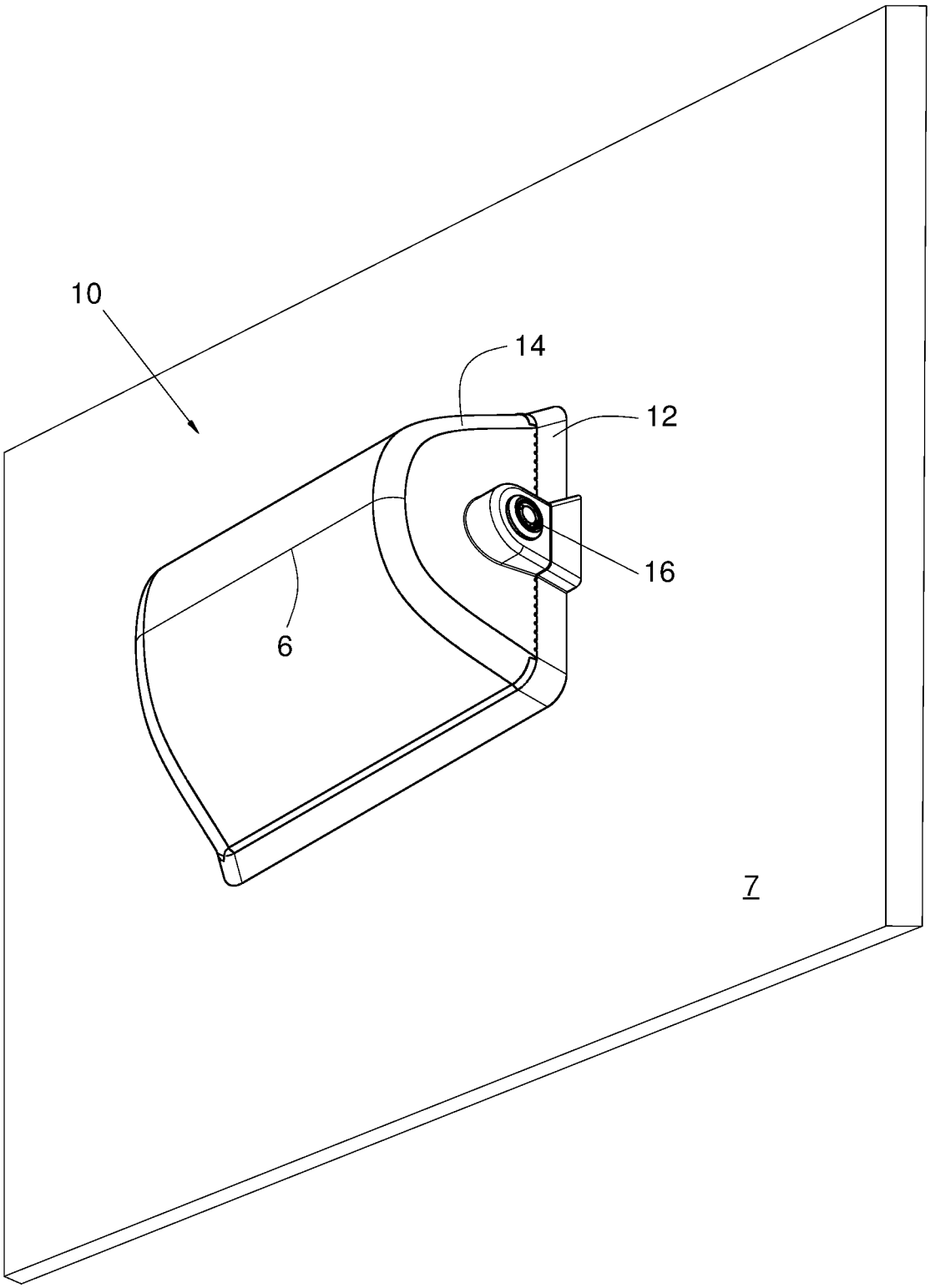
FIG. 1 is a perspective view of an installation of an example ligature-resistant thermostat cover 10.
Figure 11:
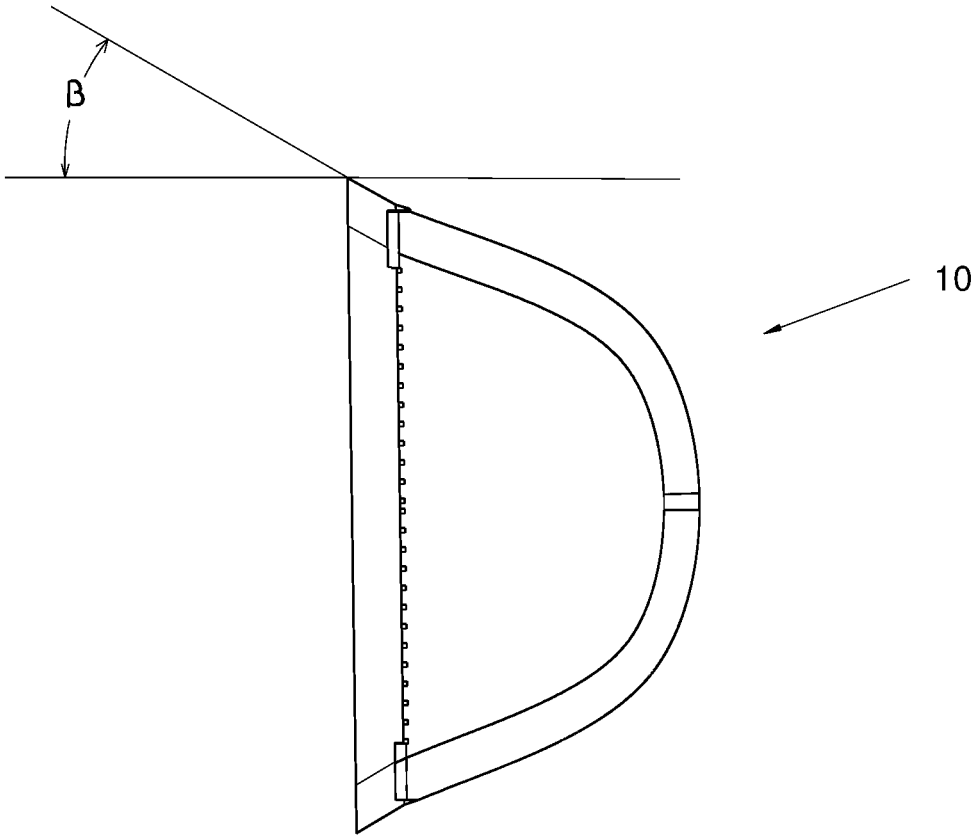
FIG. 11 is a left side view illustrating design features of example ligature-resistant thermostat cover 10.
Figure 12:
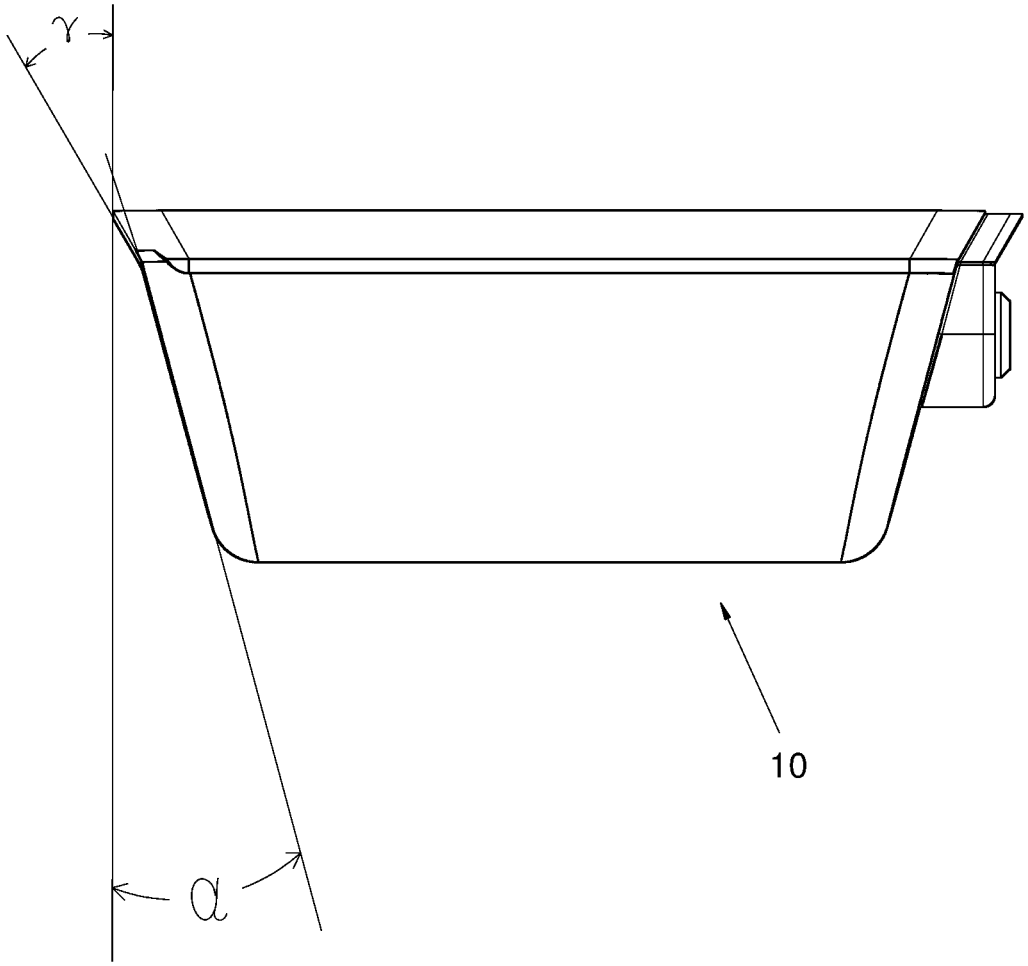
FIG. 12 is a top view illustrating design features of example ligature-resistant thermostat cover 10.

Referring now to FIG. 1, a perspective view of an installation of an example ligature-resistant thermostat cover 10 is shown. Example ligature-resistant thermostat cover 10 includes a cover portion 14 that secures to a wall plate 12 that mounts ligature-resistant thermostat cover 10 to a wall 7. A locking mechanism 16 locks cover portion 14 to wall plate 12 to prevent unauthorized access to a thermostat (not shown) mounted on wall 7 and to prevent disassembly of ligature-resistant thermostat cover 10 in a manner that might support formation of a ligature. Cover portion 14 in the example is a transparent molded plastic piece, although the method of manufacturing and selection of material is not a limitation of the invention, except as specified in the Claims. Cover portion 14 has a first curvature that extends downward from wall plate 12 at a top face of cover portion 14 and terminates at an apex line 6 below which a second curvature extends downward to the bottom face of cover portion 14 from apex line 6, which may be a complementary curvature to the first curvature as shown. The sides of cover portion 14 are inclined inward until a radius is reached that extends from the ends of apex line 6 to the inclined sides of cover portion 14. Referring additionally to FIG. 12, inward inclination angle $\alpha$, which is 15 degrees in the example, is shown. Wall plate 12 has side, top, and bottom faces that are inclined or curved as needed to provide a relatively smooth transition from the curvatures and inclines of the surfaces of cover portion 14 outward to wall 7, to prevent suspension of a ligature from wall plate 12 or the transition between wall plate 12 and cover portion 14. FIG. 12 shows an inclination angle $\gamma$ along the left side of wall plate 12, which is 30 degrees in the example. Referring additionally to FIG. 11, an inclination angle $\beta$ of the top and bottom edges of wall plate is shown, which is 35 degrees in the example.

Figure 2:
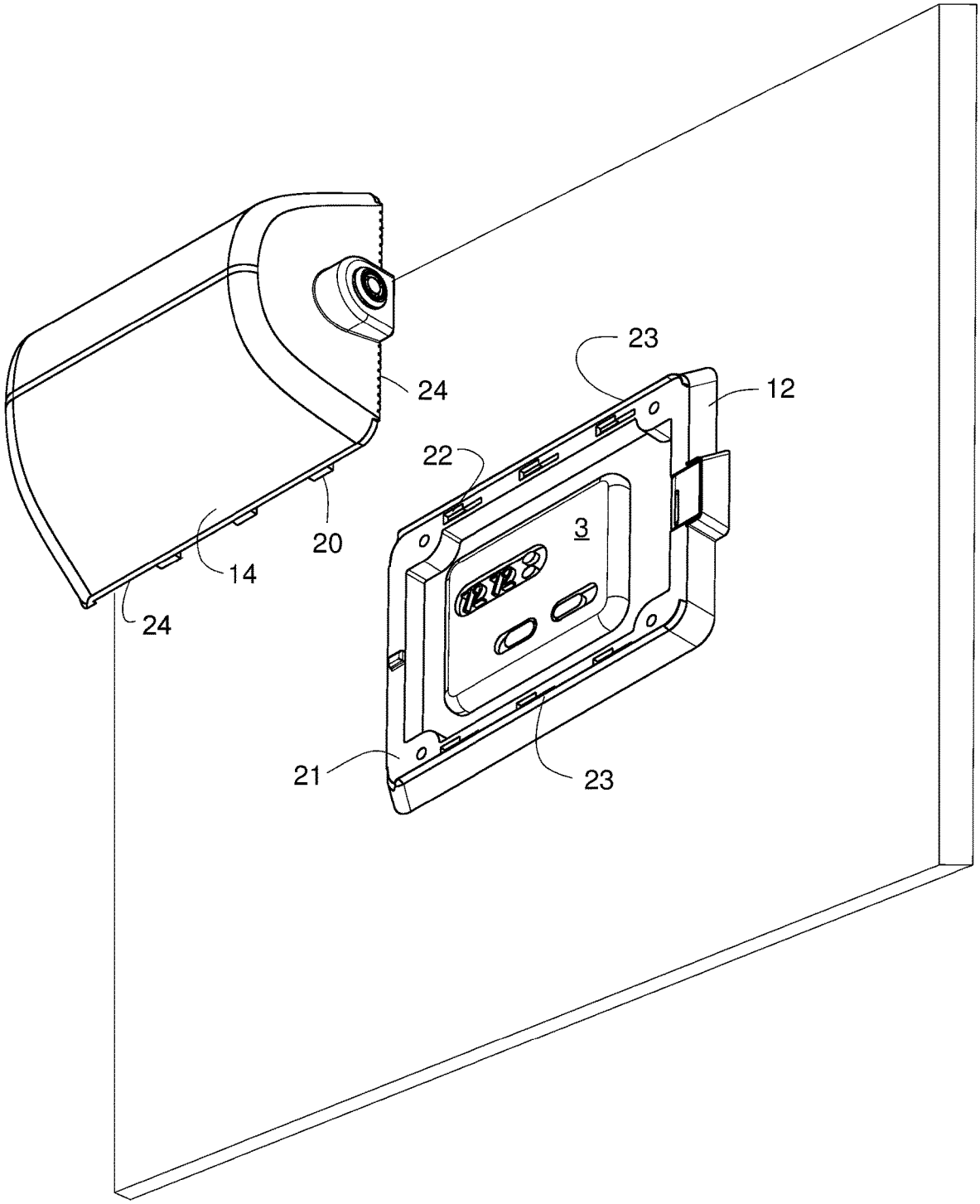
FIG. 2 is a perspective view of an installation of example ligature-resistant thermostat cover 10, with a front cover portion 14 thereof removed from a wall plate portion 12 thereof.

Referring now to FIG. 2, an exploded perspective view of example ligature-resistant thermostat cover 10 is shown with cover portion 14 removed to reveal the location of a thermostat 3 mounted within a central void of wall plate 12. A front profile 21 of wall plate 12 provides a mating surface that matches a rear profile 24 of cover portion 14 in width and height so that cover portion 14 is snug to wall plate 12 when cover portion 14 is secured. Front profile 21 of wall plate 12 also includes a pair of ridges 23 that protrude outward from the top and bottom edges of wall plate 12 and extend around the corner radii to the sides of wall plate 12 around front profile 21, to prevent insertion of a ligature at the top or bottom of ligature-resistant thermostat cover 10 between wall plate 12 and cover portion 14. A set of mating features in the form of hooks 20 are provided at the back bottom and top edges of cover portion and, when cover portion 14 is installed, engage with a matching set of mating features in the form of recesses 22 provided through the front face of wall plate 12 along the top and bottom of the front face of wall plate 12. Recesses 22 have a rectangular profile, as does the lateral profile of hooks20 and have two different heights. The greater height portion of recesses 22, seen at the leftmost end of recesses 22, permits easy insertion of hooks 20.The lower height portion of recesses 22, seen at the rightmost end of recesses 22, secures hooks 20 over the lower profile portion of recesses 22 to hold cover portion 14 in place once cover portion 14 has been placed with hooks 20 inserted within corresponding recesses 22 and then slid to the right, which secures hooks 20 over the bottom edge of the lower height profile portion of recesses 22 and also engages locking mechanism 16, as will be described in further detail below.

Figure 3A:
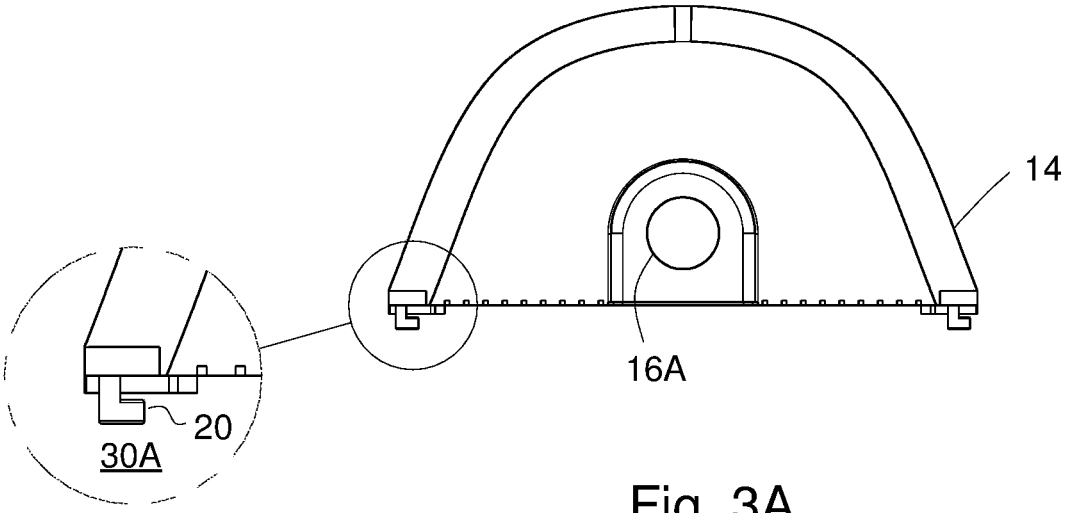
FIG. 3A is a right side view of cover portion 14 of the example ligature-resistant thermostat cover 10.
Figure 3B:
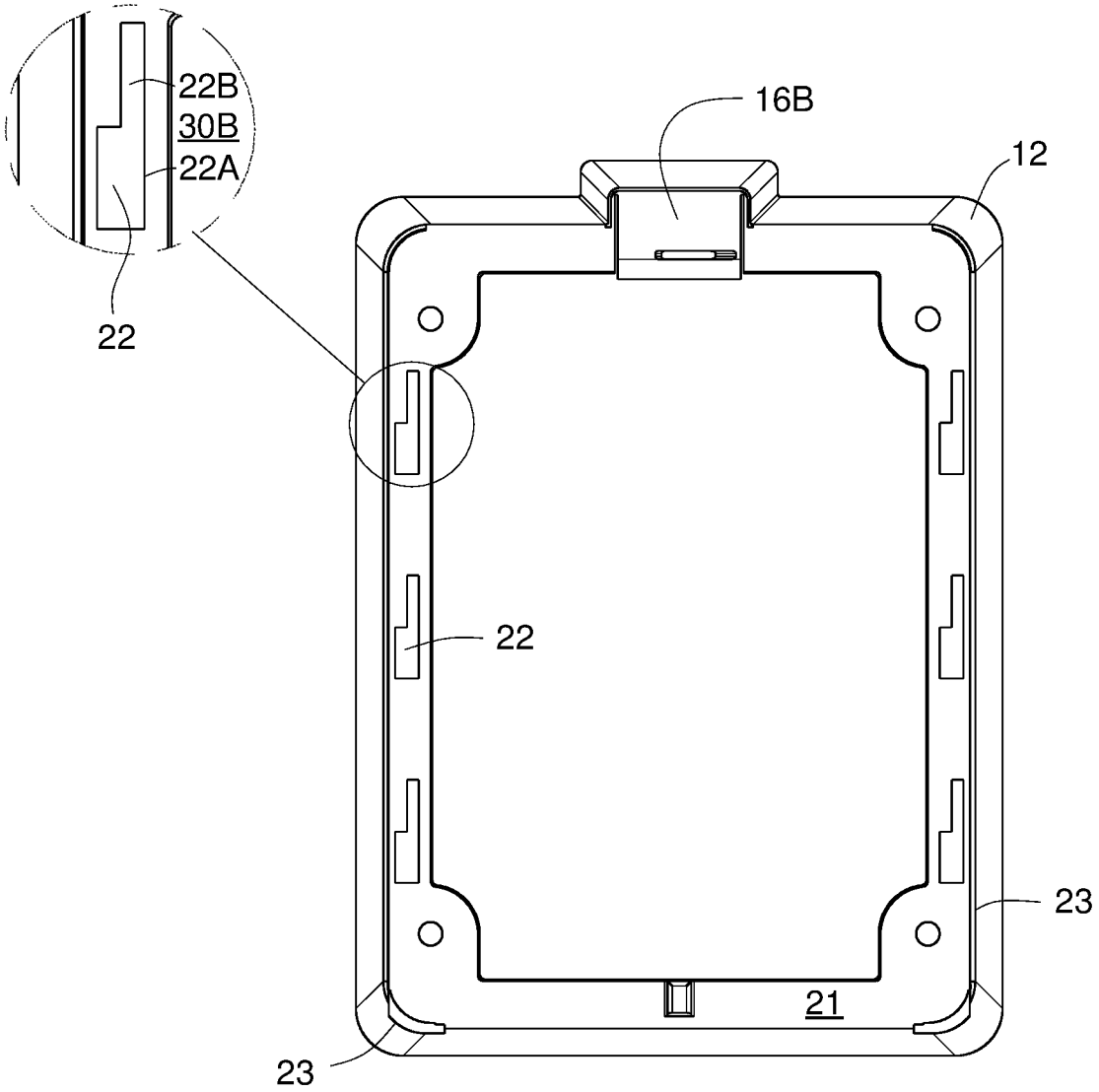
FIG. 3B is a rear view of wall plate portion 12 of the example ligature-resistant thermostat cover 10.

Referring now to FIG. 3A and FIG. 3B, further details of hooks 20 in cover portion 14 as illustrated in the right side view of FIG. 3A and recesses 22 in wall plate 12 as illustrated in the front view of FIG. 3B are shown. Hooks 20, as seen in detail 30A, have an open side facing downward, so that hooks 20 can be inserted in a larger width portion 22A of recesses 22 as seen in detail 30B and suspended by the bottom edge of recesses 22 to suspend cover portion 14 in place before sliding cover portion 14 to the right to secure hooks in a narrower width portion 22B of recesses 22 and engage locking mechanism 16, which has a keylock 16A portion and is secured to wall plate 12 by a backplate 16B portion of locking mechanism 16 formed in wall plate 12.

Figure 4:
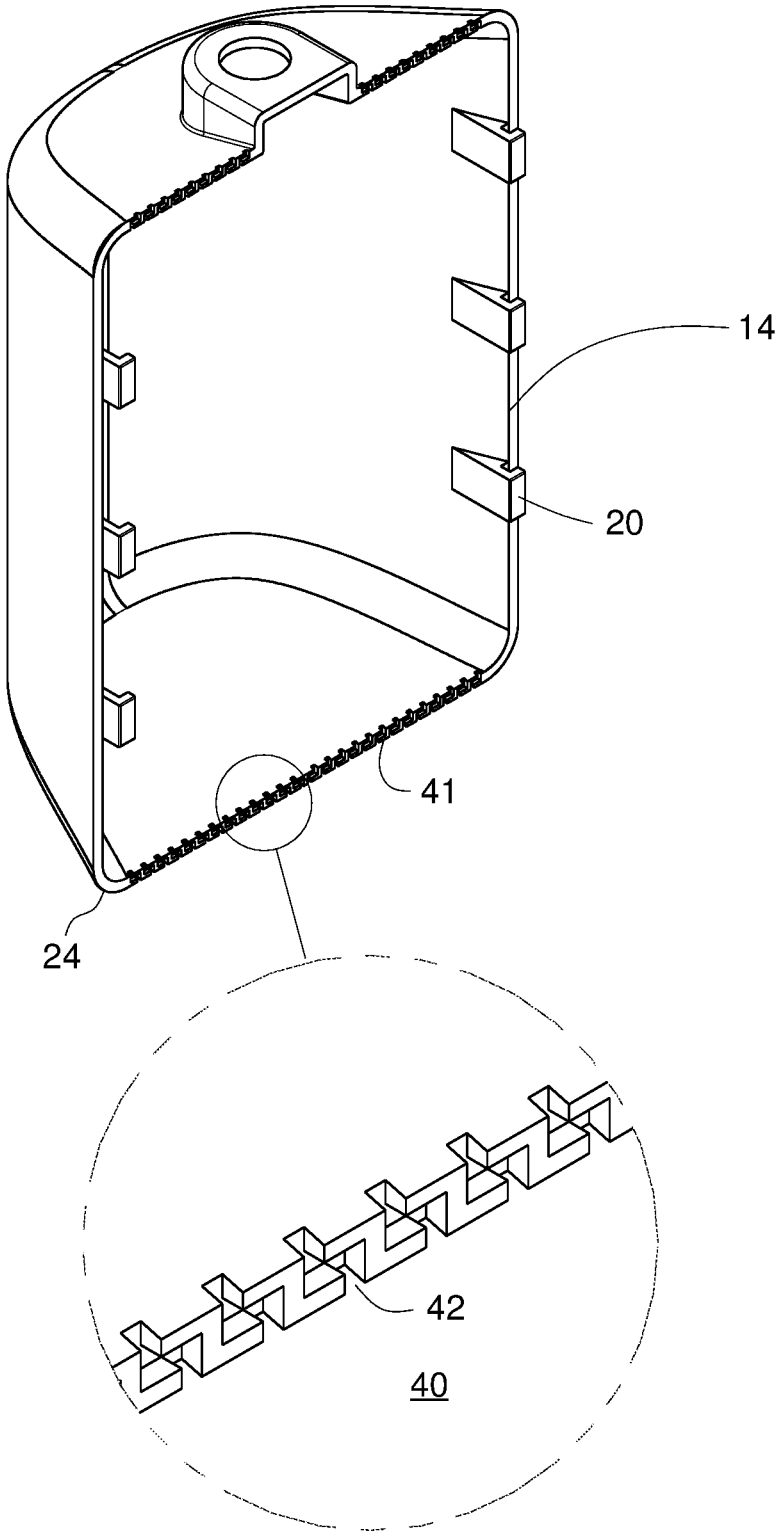
FIG. 4 is a rear left perspective view of cover portion 14 of ligature-resistant thermostat cover 10.

Referring now to FIG. 4, further details of cover portion 14 are shown. Along the right and left sides of rear profile 24 of cover portion 14 a vent pattern 41 is formed in cover portion 14 that has a plurality of z-shaped channels 42 that provide blind passages for air circulation, as shown in detail callout 40. Z-shaped channels 42 are sufficiently long in the direction of the height of cover portion 14 that a ligature-forming element, such as a piece of dental floss, or even a stiff wire cannot be inserted into a first one of z-shaped channels 42 to emerge in another one of z-shaped channels 42, due to the bending of the ligature-forming element that would be required to pass through the first one of the z-shaped channels 42. However, air can pass freely through z-shaped channels 42, providing ventilation for thermostat 3 (not shown) both for heat dissipation and to provide an accurate temperature reading of the room air.

Figure 5B:
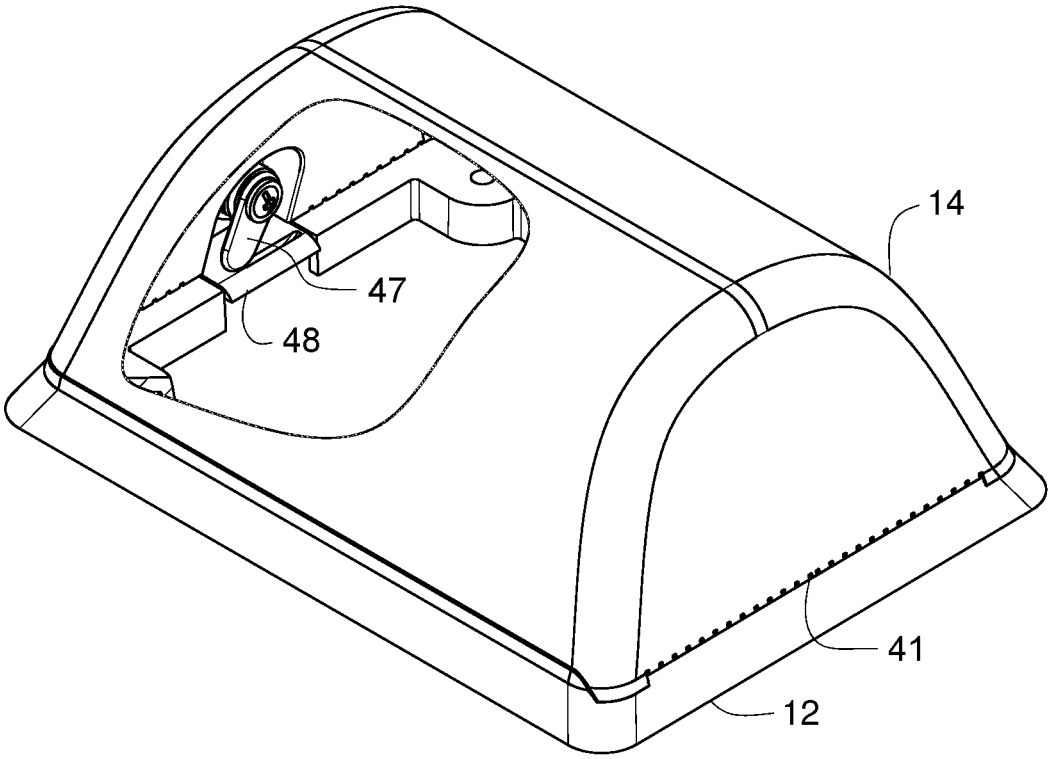
FIG. 5A is an upper left perspective view with a cutaway and FIG. 5B is a rear perspective view showing details of example ligature-resistant thermostat cover 10.
Figure 5A:
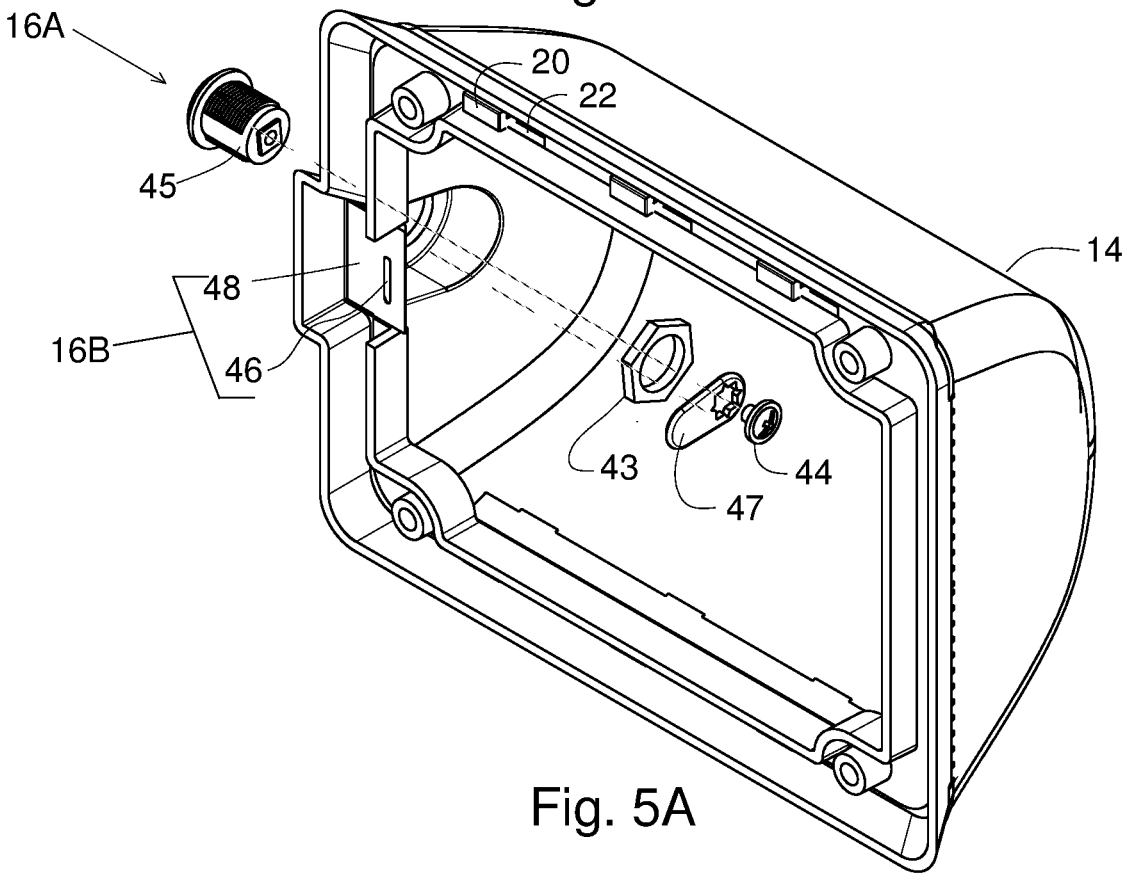

Referring now to FIG. 5A and FIG. 5B, details of locking mechanism 16 formed by keylock 16A and backplate portion 16B are shown. Keylock 16A includes a lock chamber 45 that is secured through a circular aperture in cover portion 14 by a nut 43 and a locking tab 47 is secured to the interior end of keylock 16A by a bolt 44. Rotation of a key inserted in keylock 16A rotates locking tab 47 so that in the locked position, locking tab 47 faces the rear of cover portion 14. Locking tab 47 engages with an aperture 46 formed in a lock plate 48 secured within cover portion 14, and lock plate 44 is made from a flexible material such as a thin spring steel sheet, so that keylock 16A can be secured prior to installation of cover portion 14 on wall plate 12. When cover portion 14 is slid rightwards while hooks 20 are disposed within recesses 22, locking tab 47 will flex lock plate 48 until locking tab 48 slides into aperture 46 with an audible "click" that indicates that cover portion 14 is secured and locked.

Figure 6:
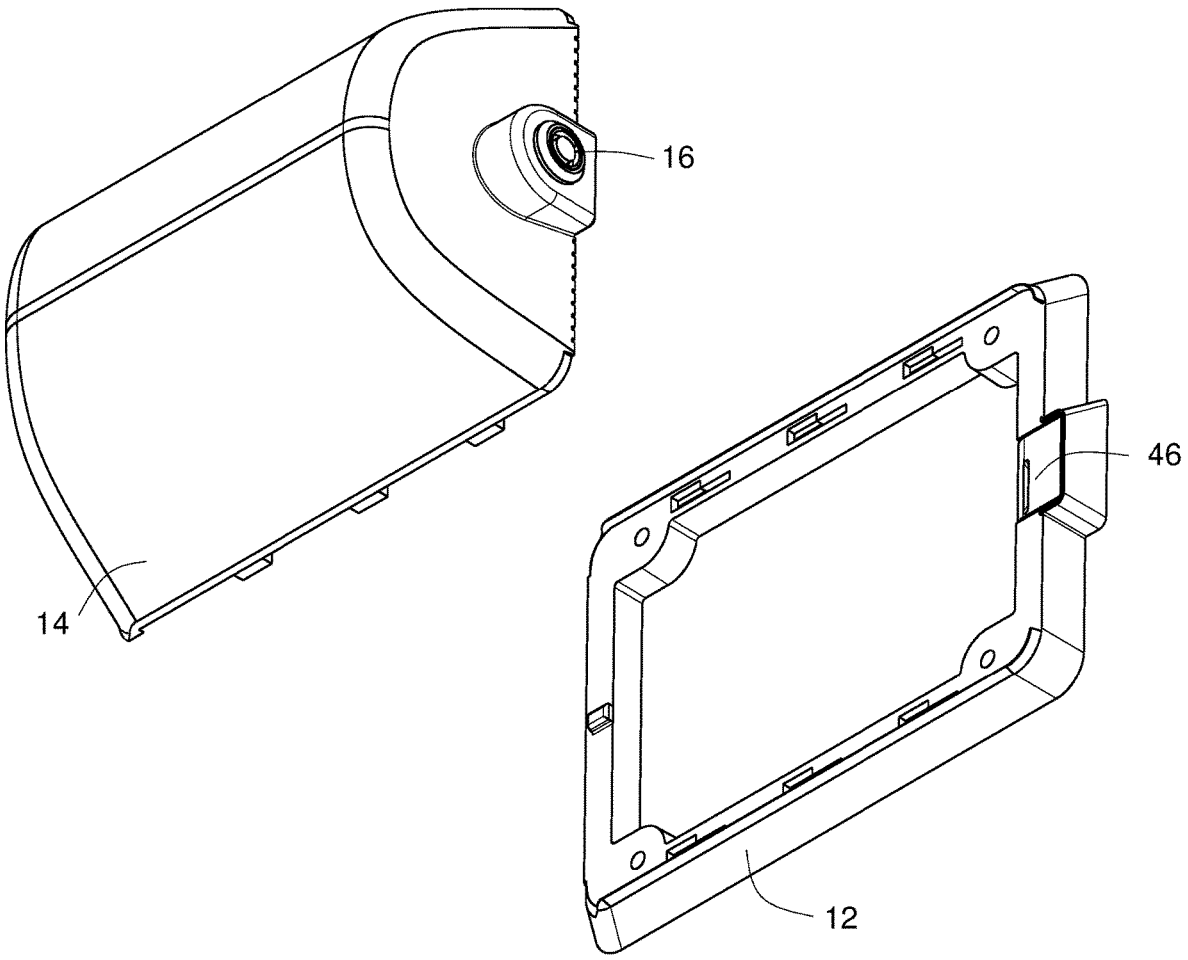
FIG. 6 is a lower right exploded perspective view illustrating design features of example ligature-resistant thermostat cover 10.
Figure 7:
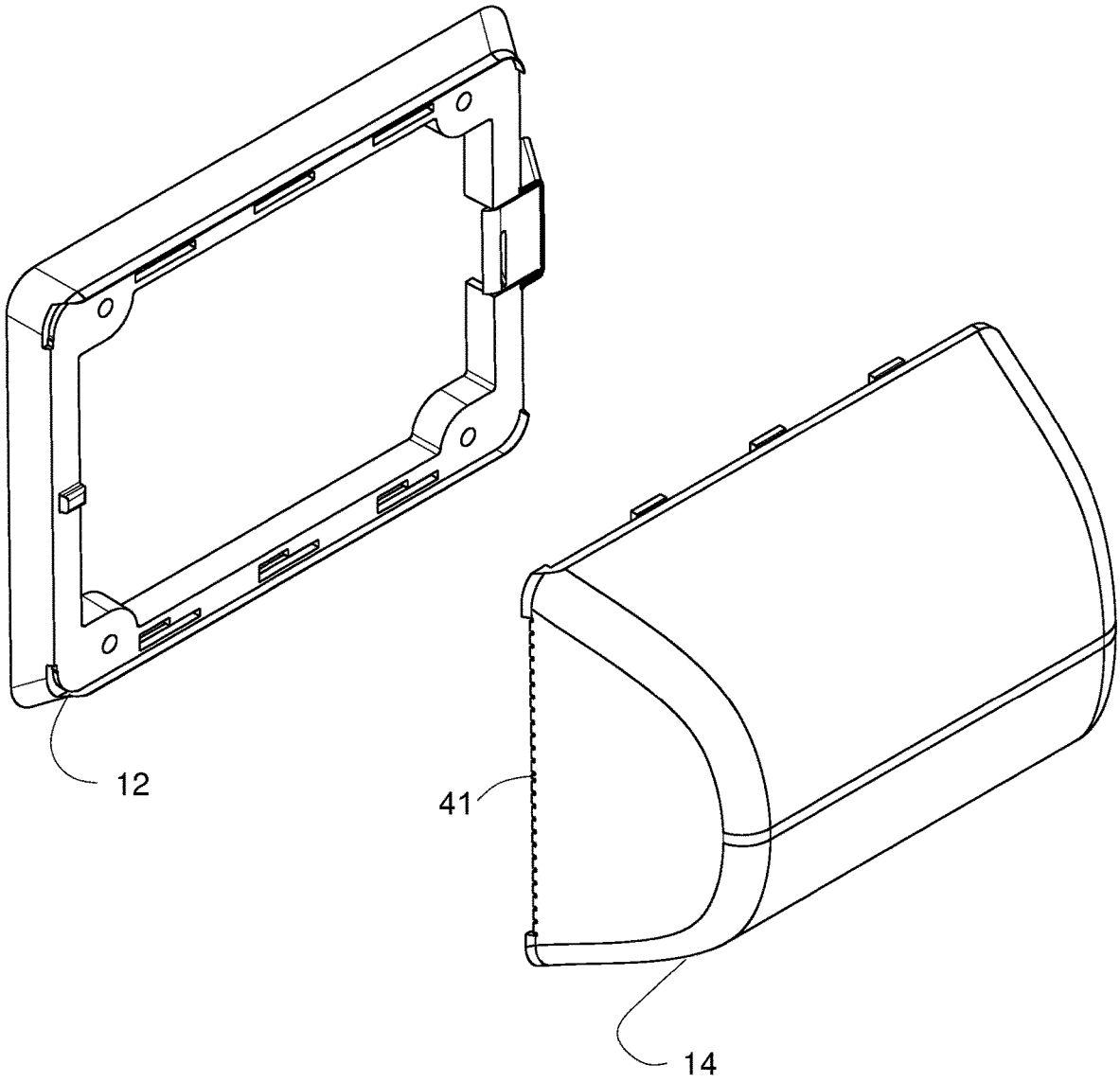
FIG. 7 is an upper-left exploded perspective view illustrating design features of example ligature-resistant thermostat cover 10.
Figure 8:
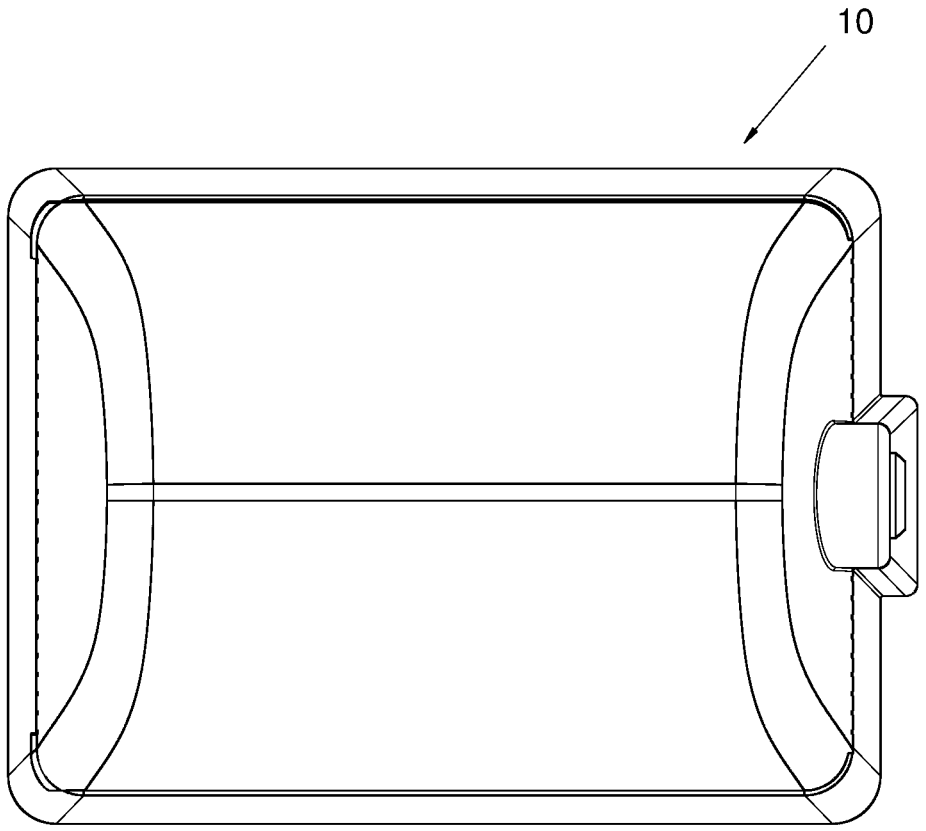
FIG. 8 is a front view illustrating design features of example ligature-resistant thermostat cover 10.
Figure 9:
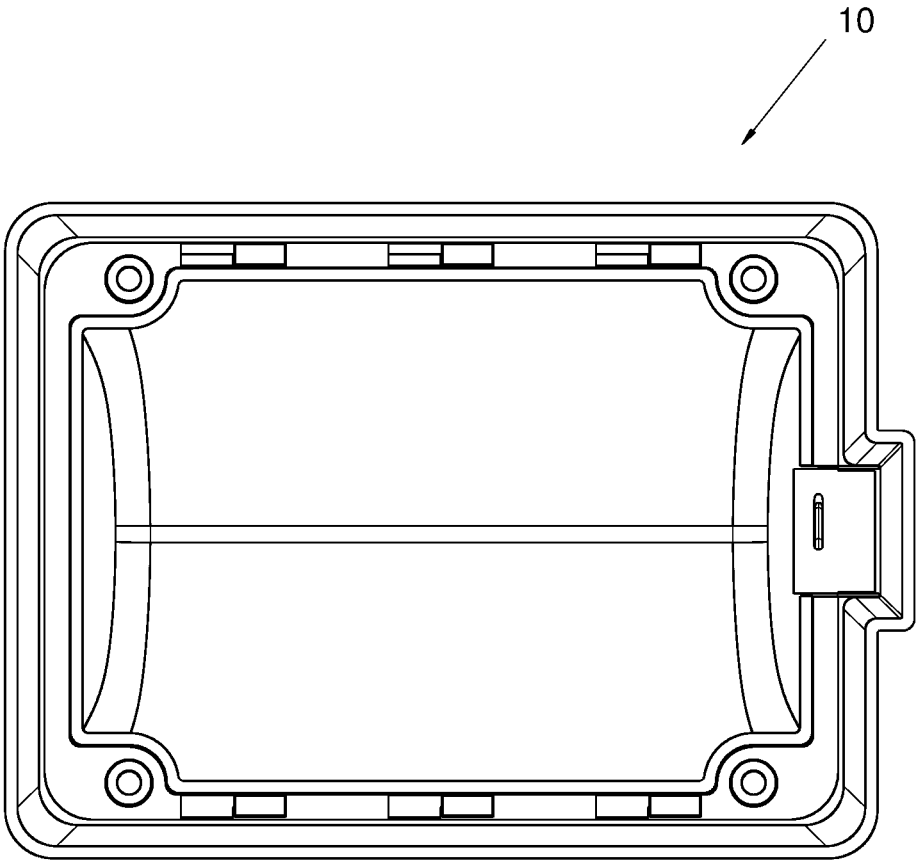
FIG. 9 is a rear view illustrating design features of example ligature-resistant thermostat cover 10.
Figure 10:
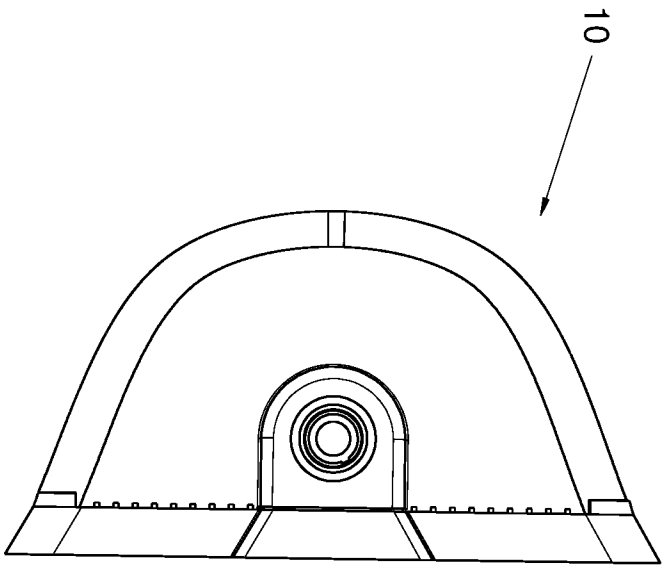
FIG. 10 is a right side view illustrating design features of example ligature-resistant thermostat cover 10.
Figure 13:
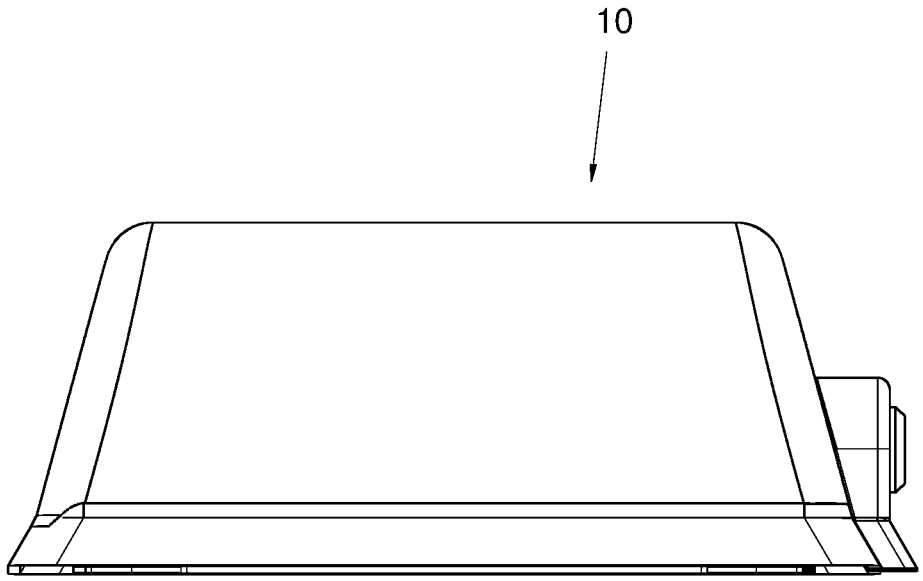
FIG. 13 is a bottom view illustrating design features of example ligature-resistant thermostat cover 10.

FIG. 6 through FIG. 13 depict design features of example ligature-resistant thermostat cover 10, in which FIG. 6 is a lower right exploded perspective view, FIG. 7 is an upper left exploded perspective view, FIG. 8 is a front view, FIG. 9 is a rear view, FIG. 10 is a right side view, FIG. 11 is a left side view, FIG. 12 is a top view and FIG. 13 is a bottom view illustrating design features of the above-described example ligature-resistant thermostat cover 10.

While the invention has been particularly shown and described with reference to the preferred embodiment thereof, it will be understood by those skilled in the art that the foregoing and other changes in form, and details may be made therein without departing from the spirit and scope of the invention.

What is claimed is:

1. A ligature-resistant cover, comprising:

a wall plate for securing to a wall and having a central aperture for accommodating a wall mounted device, wherein the wall plate has a rear surface for contacting the wall around the central aperture, wherein the central aperture extends from the rear surface through to a front surface of the wall plate that has a top edge located at a topmost extent of the wall plate and a bottom edge located at a bottommost extent of the wall plate;

a cover portion having a rear perimeter sized so that edges of the cover portion do not extend beyond the front surface of the wall plate when the cover portion is secured to the wall plate with the rear perimeter of the cover portion contacting the front surface of the wall plate, wherein the front surface of the cover portion extends to an apex line of the cover portion from the rear surface of the cover portion, wherein the front surface of the cover portion has a first curvature extending from a bottom outer edge of the cover portion to the apex line and a second curvature extending from a top outer edge of the cover portion and extending to the apex line so that the first curvature and the second curvature provide a continuously curving front surface of the cover portion, and wherein the wall plate has an incline or a third curvature at a top face thereof that provides a first continuously sloping surface that prevents support of a ligature by the top face of the wall plate and at a junction between the cover portion and the wall plate; and a locking mechanism provided on the cover portion for securing the cover portion to the wall plate.

2. The ligature-resistant cover of claim 1, wherein the wall plate has a fourth curvature at a bottom face thereof to reduce an angle between the bottom face of the wall plate and the second curvature, so that when the cover portion is secured to the wall plate, the bottom face of the wall plate and the cover portion provide a second continuously sloping surface below the apex line and extending from the apex line to the wall.

3. The ligature-resistant cover of claim 1, wherein the front surface of the wall plate further includes ridge protrusions extending along the top edge and the bottom edge thereof, and wherein the top outer edge and the bottom outer edge of the cover portion define an indentation extending along the bottom outer edge and the outer top edge that is dimensioned to receive at least a portion of a corresponding one of the protrusions, so that a ship-lap joint is formed along a top edge and a bottom edge of the ligature-resistant cover to prevent insertion of a ligature between the wall plate and the cover portion along the top outer edge and the bottom outer edge of the cover portion.

4. The ligature-resistant cover of claim 1, wherein the cover portion has a fifth curvature extending along a first side of the cover portion from the front surface of the cover portion at a first end of the apex line toward the rear surface of the cover portion and a sixth curvature extending along a second side of the cover portion from the front surface of the cover portion at a second end of the apex line toward the rear surface of the cover portion.

5. The ligature-resistant cover of claim 4, wherein the fifth curvature is a radius extending from the first end of the apex line along the front of the cover portion and extending to a first vertical line along the first side of the cover portion and wherein the first side of the cover portion is inclined inward from the rear surface of the cover portion to the first line, and wherein the sixth curvature is a radius extending from the second end of the apex line along the front of the cover portion and extending to a second vertical line along the second side of the cover portion and wherein the second side of the cover portion is inclined inward from the rear surface of the cover portion to the first line.

6. The ligature-resistant cover of claim 5, wherein first and second sides of the cover portion are inclined inward at an angle of 15 degrees from a direction perpendicular to the wall toward a midpoint of the apex line.

7. The ligature-resistant cover of claim 1, wherein the rear surface of the cover portion and the front surface of the wall plate define passages that permit entry and exit of air between an interior and an exterior of the ligature-resistant cover.

8. The ligature-resistant cover of claim 7, wherein the passages are blind passages having at least one turn such that an object cannot be passed therethrough in a single direction.

9. The ligature-resistant cover of claim 1, wherein the locking mechanism has a member that flexes to permit the cover portion to be installed to the wall plate when the locking mechanism is secured in a locked position.

10. The ligature-resistant cover of claim 1, wherein the wall plate incorporates first mating features and the cover portion comprises second mating features for securing the cover portion to the wall plate.

11. The ligature-resistant cover of claim 9, wherein the first mating features are voids in the wall plate and the second mating features are hooks provided inside of the back profile of the cover portion for hooking into the voids to secure the cover portion to the wall plate.

12. The ligature-resistant cover of claim 11, wherein the voids are rectangular voids disposed along a bottom portion of the wall plate and along a top portion of the wall plate, and wherein first ones of the voids have a first rectangular profile of a first width and wherein second ones of the voids have a second rectangular void of a second width that differs from the first width, wherein the rectangular voids extend parallel to the apex line of the cover portion when the cover portion is installed, so that the hooks are insertable in a corresponding one of the voids in the portion of the rectangular profile that has a greater one of the two differing widths, and wherein the hooks are secured by sliding the cover portion along a direction of the apex line so that the hooks slide into the portion of the rectangular profile that has a lesser one of the two differing widths.

13. A ligature-resistant cover, comprising:

a wall plate for securing to a wall and having a central aperture for accommodating a wall mounted device, wherein the wall plate has a rear surface for contacting the wall around the central aperture, wherein the central aperture extends from the rear surface through to a front surface of the wall plate that has a top edge located at a topmost extent of the wall plate and a bottom edge located at a bottommost extent of the wall plate;

a cover portion having a rear perimeter sized so that edges of the cover portion do not extend beyond the front surface of the wall plate when the cover portion is secured to the wall plate with the rear perimeter of the cover portion contacting the front surface of the wall plate, wherein the front surface of the cover portion extends to an apex line of the cover portion from the rear surface of the cover portion, wherein the front surface of the cover portion has a first curvature extending from a bottom outer edge of the cover portion to the apex line and a second curvature extending from a top outer edge of the cover portion and extending to the apex line so that the first curvature and the second curvature provide a continuously curving front surface of the cover portion, and wherein the wall plate has an incline or a third curvature at a top face thereof that provides a first continuously sloping surface that prevents support of a ligature by the top face of the wall plate and at a junction between the cover portion and the wall plate, wherein the wall plate has a fourth curvature at a bottom face thereof to reduce an angle between the bottom face of the wall plate and the second curvature, so that when the cover portion is secured to the wall plate, the bottom face of the wall plate and the cover portion provide a second continuously sloping surface below the apex line and extending from the apex line to the wall, wherein the front surface of the wall plate further includes ridge protrusions extending along the top edge and the bottom edge thereof, and wherein the top outer edge and the bottom outer edges of the cover portion define an indentation extending along the bottom outer edge and the outer top edges that is dimensioned to receive at least a portion of a corresponding one of the protrusions, so that a ship-lap joint is formed along a top edge and a bottom edge of the ligature-resistant cover to prevent insertion of a ligature between the wall plate and the cover portion along a the top outer edge and the bottom outer edge of the cover portion, wherein the cover portion has a fifth curvature extending along a first side of the cover portion from the front surface of the cover portion at a first end of the apex line toward the rear surface of the cover portion and a sixth curvature extending along a second side of the cover portion from the front surface of the cover portion at a second end of the apex line toward the rear surface of the cover portion, wherein the fifth curvature is a radius extending from the first end of the apex line along the front of the cover portion and extending to a first vertical line along the first side of the cover portion and wherein the first side of the cover portion is inclined inward from the rear surface of the cover portion to the first line, and wherein the sixth curvature is a radius extending from the second end of the apex line along the front of the cover portion and extending to a second vertical line along the second side of the cover portion and wherein the second side of the cover portion is inclined inward from the back of the cover portion to the first line wherein first and second sides of the cover portion are inclined inward at an angle of 15 degrees from a direction perpendicular to the wall toward a midpoint of the apex line, wherein the rear surface of the cover portion and the front surface of the wall plate define passages that permit entry and exit of air between an interior and an exterior of the ligature-resistant cover, wherein the passages are blind passages having at least one turn such that an object cannot be passed therethrough in a single direction;

and a locking mechanism provided on the cover portion for securing the cover portion to the wall plate, wherein the locking mechanism has a member that flexes to permit the cover portion to be installed to the wall plate when the locking mechanism is secured in a locked position, wherein the wall plate incorporates first mating features and the cover portion comprises second mating features for securing the cover portion to the wall plate, wherein the first mating features are voids in the wall plate and the second mating features are hooks provided inside of the rear surface of the cover portion for hooking into the voids to secure the cover portion to the wall plate, wherein the voids are rectangular voids disposed along a bottom portion of the wall plate and along a top portion of the wall plate, and wherein first ones of the voids have a first rectangular profile of a first width and wherein second ones of the voids have a second rectangular void of a second width that differs from the first width, wherein the rectangular voids extends parallel to the apex line of the cover portion when the cover portion is installed, so that the hooks are insertable in a corresponding ones of the voids in the portion of the rectangular profile that has a greater one of the two differing widths, and wherein the hooks are secured by sliding the cover portion along a direction of the apex line so that the hooks slide into the portion of the rectangular profile that has a lesser one of the two differing widths.

14. A method of securing a wall-mounted device and preventing ligature formation over the wall-mounted device, the method comprising:

providing a wall with a wall-mounted device;

fastening a wall plate of an anti-ligature device cover to the wall, the wall plate having a central aperture for surrounding the wall-mounted device, wherein the wall plate has a rear surface for contacting the wall around the central aperture, wherein the central aperture extends from the rear surface through to a front surface of the wall plate that has a top edge located at a topmost extent of the wall plate and a bottom edge located at a bottommost extent of the wall plate;

attaching a cover portion of the anti-ligature device cover to the wall plate, the cover portion having a rear surface sized so that edges of the cover portion do not extend beyond the front surface of the wall plate when the cover portion is secured to the wall plate with the rear perimeter of the cover portion contacting the front surface of the wall plate, wherein the front surface of the cover portion extends to an apex line of the cover portion from the rear surface of the cover portion, wherein the front surface of the cover portion has a first curvature extending from a bottom outer edge of the cover portion to the apex line and a second curvature extending from a top outer edge of the cover portion and extending to the apex line so that the first curvature and the second curvature provide a continuously curving front surface of the cover portion, and wherein the wall plate has an incline or a third curvature at a top face thereof that provides a first continuously sloping surface that prevents support of a ligature by the top face of the wall plate and at a junction between the cover portion and the wall plate; and operating a locking mechanism provided on the cover portion to secure the cover portion to the wall plate.

15. The method of claim 14, wherein the fastening fastens the wall plate having a fourth curvature at a bottom face thereof to reduce an angle between the bottom face of the wall plate and the second curvature, so that when the cover portion is secured to the wall plate, the bottom face of the wall plate and the cover portion provide a first continuously curved surface below the apex line and extending from the apex line to the wall.

16. The method of claim 14, further comprising preventing insertion of a ligature between the wall plate and the cover portion along a top and bottom edge of the cover portion by providing ridge protrusions extending along the top edge and the bottom edge of the wall plate, and wherein the top outer edge and the bottom outer edge of the cover portion define an indentation extending along the bottom outer edge and the outer top edge that is dimensioned to receive at least a portion of a corresponding one of the protrusions, so that a ship-lap joint is formed along a top edge and a bottom edge of the ligature-resistant cover.

17. The method of claim 15, wherein the fifth curvature is a radius extending from the first end of the apex line along the front of the cover portion and extending to a first vertical line along the first side of the cover portion and wherein the first side of the cover portion is inclined inward from the rear surface of the cover portion to the first line, and wherein the sixth curvature is a radius extending from the second end of the apex line along the front of the cover portion and extending to a second vertical line along the second side of the cover portion and wherein the second side of the cover portion is inclined inward from the rear surface of the cover portion to the first line.

18. The method of claim 14, further comprising permitting entry and exit of air between an interior and an exterior of the ligature-resistant device cover through passages defined by the rear surface of the cover portion and the front surface of the wall plate.

19. The method of claim 18, further comprising preventing passage of an object through the passages by providing the passages as blind passages having at least one turn.

20. The method of claim 14, further comprising permitting installation of the cover portion to the wall plate when the locking mechanism is secured in a locked position, by providing a locking mechanism having a member that flexes.

* * * * *